United States Patent [19]

Allen

[11] Patent Number: 4,760,794

[45] Date of Patent: Aug. 2, 1988

[54] EXPLOSIVE SMALL ARMS PROJECTILE

[76] Inventor: Norman Allen, P.O. Box 26185, Arcadia 0007, South Africa

[21] Appl. No.: 370,202

[22] Filed: Apr. 21, 1982

[51] Int. Cl.[4] ..... F42B 11/10

[52] U.S. Cl. ..... 102/473; 102/488; 102/514; 102/517

[58] Field of Search ..... 102/364, 501, 506–510, 102/514, 515, 517–519, 473, 516, 487, 488

[56] References Cited

U.S. PATENT DOCUMENTS

| | | | |
|---|---|---|---|
| 2,780,995 | 2/1957 | Migliaccio | 102/364 |
| 3,120,809 | 2/1964 | Custard | 102/364 |
| 3,370,536 | 2/1968 | Francis et al. | 102/364 |
| 3,941,057 | 3/1976 | Peterson et al. | 102/518 X |
| 4,005,660 | 2/1977 | Pichard | 102/501 |
| 4,216,722 | 8/1980 | Angell | 102/517 X |
| 4,384,528 | 5/1983 | Moore et al. | 102/519 X |

FOREIGN PATENT DOCUMENTS

| | | | |
|---|---|---|---|
| 414005 | 7/1934 | United Kingdom | 102/473 |

*Primary Examiner*—Harold Tudor

*Attorney, Agent, or Firm*—Roylance, Abrams, Berdo & Goodman

[57] ABSTRACT

An explosive small arms projectile is disclosed. Prior art projectiles of this kind include a lead core for increased mass which core is formed with a blind hole for receiving an explosive and the necessary detonating device.

The projectile of the invention comprises a jacket (102) of a metal with a specific gravity in excess of 13, Tantalum or a Tantalum/Tungsten alloy being preferred. The entire interior of the jacket is left free for the explosive charge; the jacket (102) has increased mechanical, structural and tensile characteristics over prior art projectiles and the projectile has better rotational ballistic stability in use due to the redistribution of the mass thereof to the periphery.

7 Claims, 1 Drawing Sheet

EXPLOSIVE SMALL ARMS PROJECTILE

This invention relates to an explosive small arms projectile, that is a projectile filled with an explosive charge.

In this specification, the subject of the invention will be referred to as a "projectile", although strictly speaking a bullet or missile is a projectile only while in flight. The term "projectile" is, however, commonly used to denote the bullet or missile while at rest or whilst in flight, and will be so used in the specification.

Such projectiles are used mainly in combating crime, particularly international terrorism, where, on an aircraft, for instance, an explosive projectile may be used to take out a target from within a group of innocent bystanders. Complete penetration of the target may result in harm to the bystanders and it is therefore an object of explosive projectiles to eliminate or at least minimize, total penetration of the target while maximizing the shock from the projectile within the target.

The objective of the inclusion of high explosives (taken to include primary explosives such as Mercury Fulminate or Lead Azide, and secondary explosives such as pentaerythritol tetranitrate (PETN) or mannitol hexanitrate) in small arms projectiles may be conceived of primarily as enhancing the shocking effect of the projectile in the target and the prevention of the projectile's penetration to any point beyond the intended objective where the projectile may cause unintended injury or damage.

Known small arms projectiles are commonly constructed with a jacket of a relatively light weight yet strong material such as steel and gilding metal, and a core of a relatively heavy material which may be partly filled with explosive.

The jacket of a conventional explosive small arms projectile is typically of a wear/resistant material such as steel which is gilded or clad with gilding metal, the steel providing mechanical strength to withstand the pressures and high temperatures resulting from burning propellants and the gilding metal being provided for the purpose of reducing friction. On known explosive small arms projectiles, the steel jacket is normally thin and largely non-structural, the functions thereof being containment of the lead core more than maintaining the integrity of the projectile on impact. This results in limited penetration of a target with the result that light armor is often sufficient to prevent penetration.

In prior art small arms explosive projectiles, the explosive is normally carried within a narrow central bore formed in the lead core. The explosive may comprise a simple explosive train of an impact sensitive primary explosive, such as, for example, Lead Azide, or a more complicated version comprising three stages; a first stage constituted by an impact sensitive mechanism, an initiating or primary explosive such as, for example, Mercury fulminate as second stage; terminating in a third stage of a secondary high explosive such as (PETN). Some designs have employed, as the high explosive, a polybasic glycerol trinitrate/pyrocellulose smokeless propellant powder which is a combustible solid and an explosive, and which 'burns to detonation', but without optimal explosive utilization.

The deficiencies in the effect of prior art explosive small arms projectiles lie in failure to effect and maintain optimal required ballistic rotational stabilization, owing to limitations of conventional explosive projectile mass and mass distribution, thus leading to deficiencies in long range performance and accuracy; deficiencies in penetration owing to diminished mass; and perhaps most significantly, deficiencies in the propogation of the secondary high explosive shock wave within the necessarily narrow (5 mm diameter (3/16") in a 0.38 caliber projectile) conventional explosive column. This last deficiency results from the relatively restricted diameter of the explosive which is constrained to function in a high velocity rotational mode within a lead sheath of low strength which is subject to plastic deformation on impact. An efficient 3-stage 0.38 caliber projectile containing a 5 mm diameter PETN explosive column initiated in flight may suffer non-detonation of 10–14% of its PETN column when detonation occurs within an airfilled space.

It is an object of this invention to provide an explosive small arms projectile with the mass thereof re-distributed to the periphery so as to be subject to investment with a higher rotational stabilizing energy than was possible with prior art projectiles, resulting in improved accuracy upon chosen targets at an increased range. This includes a re-distribution of the projectile mass away from the rotational axis of the projectile whereby the in-flight ballistic rotational stabilizing force and energy of the projectile is improved with respect to known high explosive projectiles of similar total mass and configuration.

It is a further object of this invention to provide an explosive small arms projectile in which the explosive column diameter is increased as a means of reducing explosive non-utilization. It is yet a further object of this invention to provide an explosive small arms projectile, the explosive containing envelope of which shows an increase in tensile and inertial characteristics over the conventional lead or copper or steel jacketed lead projectiles.

These results are obtained by the use in an explosive small arms projectile, of a jacketing material with a specific gravity greater than 13 or a density in excess of 13 $g.cm^{-3}$, the preferred jacket material comprising Tantalum or Tantalum-Tungsten alloys, the densities of which approximate 16.6 to 16.9 $g.cm^{-3}$, the object being to provide a projectile the jacket of which has a mass equal to the entire conventional explosive or other projectile.

The metal of the jacket may alternatively be chosen from amongst the elements Hafnium, Uranium, Rhenium, Osmium, Platinum, Iridium or Gold or alloys, mixtures or compounds of the above with the proviso that the primary elemental alloy or mixture density has a specific gravity in excess of 13. Additionally, the metal can include tantalum, tungsten or an alloy thereof.

As with prior art projectiles the projectiles of the invention may be coated or gilded or, alternatively, the jacket may be metal-plated or metal clad on one or both sides.

The invention is further described with reference to the accompanying drawings in which.

Figure 1:
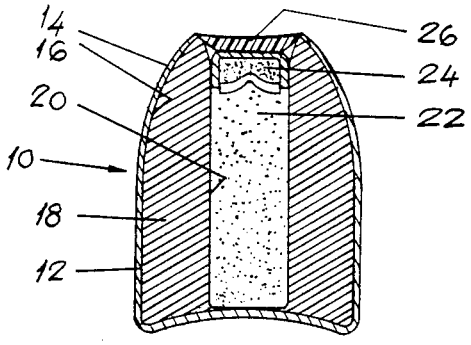
FIG. 1 is a section through a prior art explosive projectile.

The projectile 10 shown in FIG. 1 comprises a relatively thin steel jacket 12 with gilding metal 14 and 16 plated on both the inside and outside thereof. The projectile 10 is provided with a lead core 18 formed with a central bore 20 which serves as a receptacle for the explosive.

The explosive 3 may be loaded in any one of a number of ways, but for the sake of clarity is shown as comprising a charge of explosive powder 22, a commercially available small arms percussion primer 24 and a closure of resin 26.

As already explained, the purpose of the jacket is to withstand the pressures and high temperatures resulting from the burning propellants and to withstand the frictional forces between the lands and grooves of the barrel, of the firing weapon and the accelerating projectile. The lead core 18 functions to increase the mass of the projectile whereby the momentum of the projectile may be increased. The primer 24 is intended to detonate the explosive 22 on impact, but it will be appreciated that the projectile 10 will have penetrated the target to a certain extent by the time detonation occurs due to the velocity of the projectile.

The projectile shown in the drawing is enlarged for clarity and in a 0.38 caliber projectile the central bore 20 will have a diameter of 5 mm. A 0.38 caliber projectile containing a three-stage explosive column in which detonation is initiated in flight has been found to suffer non-detonation of 10–14% of its explosive column when detonation occurs within an air-filled space. The reason for this is that the conventional explosive projectile can sacrifice only a limited proportion of its total volume to explosive content in order to retain the mass thereof thus leading to an explosive column of relatively narrow diameter, in which the explosive shock wave front is propagated inefficiently particularly under the high velocity rotational condition of actual use.

As has also been mentioned, the thin steel jacket 12 performs a containment function more than anything else and possesses sufficient mechanical strength merely to withstand the frictional forces existing between the projectile and the lands and grooves of the barrel during firing. The jacket is not possessed of the mechanical strength required to maintain optimal integrity of the projectile when the projectile penetrates the target.

The disadvantages of the projectile 10 described above are therefore firstly, the sacrifice of a significant proportion of the mass as much as 20%, of the leaden mass to accommodate a certain amount of explosive, secondly, the use of a narrow diameter explosive column, thirdly, the relatively limited tensile strength and unsatisfactory inertial characteristics of the jacket or envelope and fourthly, the unsatisfactory mass distribution thereof resulting in relatively low rotational stabilising energy values compared to the projectile of the present invention. It will be seen that, in a conventional small arms explosive projectile as described above, a compromise must be struck between the core mass which is normally represented by the amount of lead in the core and the diameter of the explosive column. It is not possible, with conventional small arms explosive projectiles, to combine both the attributes of high mass and a large amount of explosive or at least an explosive column of a larger diameter.

Figure 2:
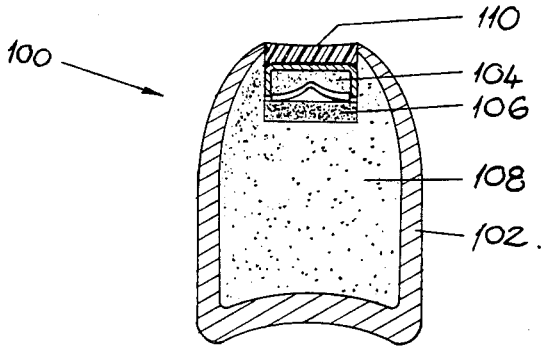
FIG. 2 is a section through an explosive projectile according to the invention.

A solution of these deficiencies may be found in the projectile 100 of the invention which is shown in FIG. 2. The projectile 100 comprises a jacket 102 of a Tantalum/Tungsten alloy (TaW) although other metals of suitably high specific gravity may be used. Because of the high specific gravity of the jacket 102 no internal high density core is required and the whole of the internal space can be filled with explosive. A three-stage explosive column is shown comprising a commercially available small arms percussion primer 104, a lead azide primary explosive layer 106, a secondary high explosive layer of PETN 108, and a sealing cap of resin 110.

The eventual mass of the projectile 100 is arranged to be at least equivalent to that of the projectile 10 described above. In projectiles of equivalent mass the provision of the heavy metal jacket 102 may not remedy entirely the mass lost in providing the projectile 10 with the explosive core, but the diminished mass is at least distributed more efficiently so as to render the mass of the projectile susceptible to investment with a higher level of rotational stabilizing energy than is possible with the projectile 10.

It will be immediately evident that the explosive column has been increased in volume by approximately 250% whereby explosive non-utilization is reduced from the 10–14% non-utilization of the prior art projectiles to a point such that is is not readily detectable and is assumed to be significantly below 1% if not effectively complete.

The tensile and inertial characteristics of the Tantalum/Tungsten alloy jacket 102 are increased with respect to the prior art jackets to a point potentially approximating the tensile characteristics of steel or alloy steel and with an improved inertial characteristic approximating 46% in excess of a lead envelope (calculated on a density basis of 16.6 $g.cm^{-3}$ for TaW and 11.4 $g.cm^{-3}$ for Pb so that $(16.6/11.4)-1=0.46$).

In addition the projectile mass is efficiently redistributed away from the rotational axis of the projectile and closer to its periphery in contact with the bore of the weapon so as to equal and exceed, in flight, the ballistic rotational stabilizing force and energy present in conventional small arms high explosive projectiles of similar total mass and configuration. This re-distribution and increased rotational stabilizing force provides for improved accuracy at longer range.

These results can be confirmed by a rough comparison, based on calculation, of the projectile of the invention with a prior art explosive projectile with reference to two long-standing American military service weapons, namely, the US Model 1911, 0.45 ACP (Colt Automatic Pistol), firing a 230 grain (14.9 g) projectile and the (30–06) US Caliber 30 (M1A2 Ball) rifle firing a 150 grain (9.7 g) projectile.

| Weapon | Projectile/Mass in grain (gram) | Muzzle Velocity in fps. ($m.5^{-1}$) | Muzzle Energy in foot pounds force (Joule) |
|---|---|---|---|
| .45 ACP | Conventional bullet 230 (14.9) | 900 (274.3) | 412 (558.6) |
| .45 ACP | Prior art explosive bullet (172.5) (11.2) | 1200 (365.8) | 1035 (1403.2) |
| US Cal.30 M1 | Conventional bullet 150 (9.7) | 2850 (868.7) | 2700 (3 660.7) |
| .45 ACP | Ta or TaW alloy explosive bullet (172.5) (11.2) | 1200 (365.8) | 4000 (5423.2) |
| Winchester Magnum (.458") | Conventional bullet 400 (25.9) | 2400 (731.5) | 5160 (6 995.9) |

From the above table, it may be seen that, whereas the conventional small arms explosive projectile is bracketed, in terms of muzzle energy, between the conventional non-explosive bullet as fired from a pistol and a conventional non-explosive bullet as fired from a rifle, an explosive pistol bullet according to the present invention is bracketed between a conventional non-explosive projectile as fired from a rifle and a conventional non-explosive projectile as fired from a big game-hunting rifle. It will, however, be appreciated that the present invention provides, in a highly manoeuverable 0.45 Caliber hand-gun, muzzle energies 50% in excess of those provided by a heavy service rifle such as the US Caliber 0.30 M1, and nearly ten times that of the non-explosive 0.45 Caliber ACP Projectile when both are compared by firing from an identical 0.45 Caliber Automatic Pistol.

The term "muzzle energy" is used here to denote the maximum theoretical energy the projectile can deliver to the target. In instances where a non-explosive projectile is retained in the target, thereby communicating the total energy thereof to the target, the energy expended in the target will, discounting frictional and gravitational energy loss, be more or less equal to the energy of the projectile at the muzzle of the weapon. If the projectile penetrates the target, substantially less of the energy of the projectile will be communicated to the target depending on the nature of the penetration with explosive projectiles, however, the projectile will, in virtually every case, transfer all of its energy to the target.

In the prior art, explosive projectile 10 shown in FIG. 1, any increase in jacket thickness will have to be made at the expense of a decrease in the core mass leading inevitably to a decrease in the total projectile mass. In the projectile 100 of the present invention, the jacket 102 can, within certain limits, be increased to any desired thickness to increase the tensile and mass characteristics of the jacket according to specific requirements, for instance, to increase the penetrational ability of the projectile. In this manner, within the space limited small arms context, the twin functions of energy absorption by a heavy mass and the jacket features of mechanical, structural and tensile strength, are condensed into a single entity. In the past, the energy absorbing heavy mass was provided by the lead core and structural integrity was provided, to a limited extent, by the steel or copper jacket. The improved stability achieved by the projectile of the present application, provides increased accuracy and this combined with the greater structural strength of the jacket provides for better penetration of light armor.

While the projectile of the present invention is described above with specific reference to a hand gun projectile, it is evidently adaptable to the entire range of small arms projectiles, the term "small arms" being taken to indicate any weapon whether mounted or not, which is portable.

We claim:

1. An explosive small arms projectile, comprising:

a unitary, one-piece jacket formed of metal having a specific gravity greater than 13, and inlcuding a base and a generally tapered, cylindrical side wall extending from said base, said side wall defining a transverse cross-sectional diameter for the projectile and being thin relative to said cross-sectional diameter, said base and side wall defining a cavity therebetween, said cavity being a major proportion of the volume of the projectile, a minor proportion of the projectile being occupied by said side wall;

an explosive charge in said cavity; and detonation means for detonating said explosive charge in said cavity.

2. An explosive smaller arms projectile according to claim 1 wherein said metal comprises tantalum.

3. An explosive small arms projectile according to claim 1 wherein said metal comprises a tantalum and tungsten alloy.

4. An explosive small arms projectile according to claim 1 when said metal is selected from the group consisting of hafnium, uranium, rhenium, osmium, platinum, iridium, gold and combinations thereof.

5. An explosive small arms projectile according to claim 4 wherein said metal comprises tantalum.

6. An explosive small arms projectile according to claim 4 wherein said metal comprises tungsten.

7. An explosive small arms projectile according to claim 4 wherein said metal comprises tantalum and tungsten alloy.

* * * * *